United States Patent [19]

Frank

[11] Patent Number: 4,816,644

[45] Date of Patent: Mar. 28, 1989

[54] VAPORIZER AND/OR FACIAL TREATMENT DEVICE

[75] Inventor: Bernard Frank, Bal Harbour, Fla.

[73] Assignee: Epilady U.S.A., Inc., Culver City, Calif.

[21] Appl. No.: 53,285

[22] Filed: May 22, 1987

[51] Int. Cl.[4] ..... F22B 1/28

[52] U.S. Cl. ..... 219/271; 219/222

[58] Field of Search ..... 219/271, 222; 4/535, 4/536, 537; 128/368; 34/99, 100

[56] References Cited

U.S. PATENT DOCUMENTS

| | | | |
|---|---|---|---|
| 2,378,929 | 6/1945 | Joyce | 128/146 |
| 3,152,240 | 10/1964 | Scott | 219/271 |
| 3,351,737 | 11/1967 | Katzman et al. | 219/271 |
| 3,493,722 | 2/1970 | Popeil | 219/222 |
| 4,361,966 | 12/1982 | Downey | 34/99 |
| 4,621,641 | 11/1986 | Frank et al. | 128/368 |

FOREIGN PATENT DOCUMENTS

| | | |
|---|---|---|
| 818397 | 10/1951 | Fed. Rep. of Germany . |
| 835157 | 4/1952 | Fed. Rep. of Germany . |
| 2079161 | 1/1982 | United Kingdom . |
| 2110543 | 6/1983 | United Kingdom . |

*Primary Examiner*—E. A. Goldberg
*Assistant Examiner*—M. M. Lateef
*Attorney, Agent, or Firm*—McAulay, Fields, Fisher, Goldstein & Nissen

[57] ABSTRACT

An apparatus for vaporizing a liquid for use in facial treatment is provided which includes a base unit for containing and vaporizing the liquid, the base unit having an opening therein to allow the liquid when vaporized to exit therethrough, and further including a hood overlying the opening for channeling the vaporized liquid exiting from the base unit. The hood includes a shield which is collapsible between open and closed positions for channeling the vaporized liquids. The shield preferably is formed from a single sheet of material divided into a plurality of panels separated by hinge lines. Lock means are provided for preventing the shield from collapsing between the open and closed positions.

17 Claims, 6 Drawing Sheets

FIG. 2
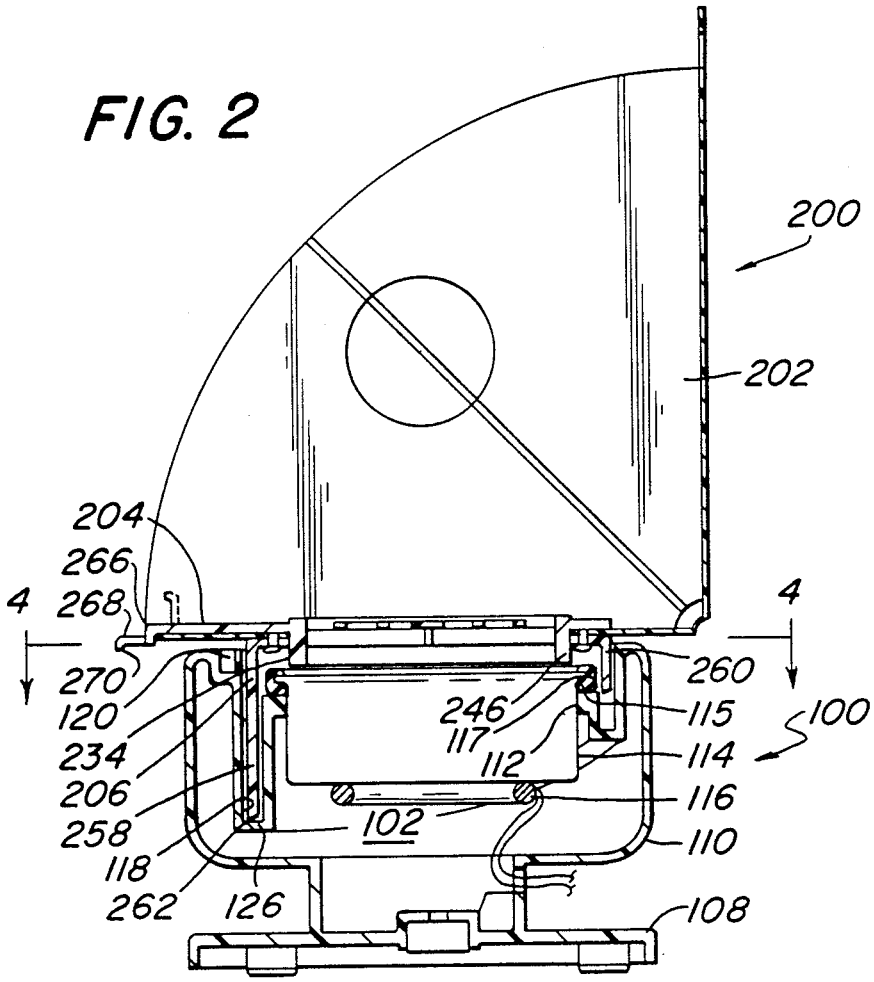
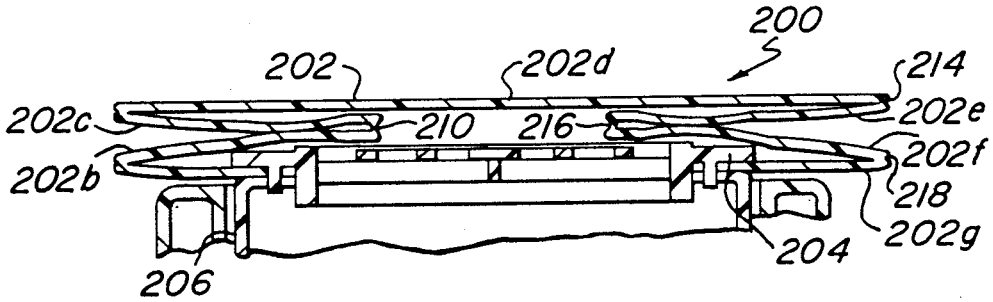
FIG. 5

FIG. 7
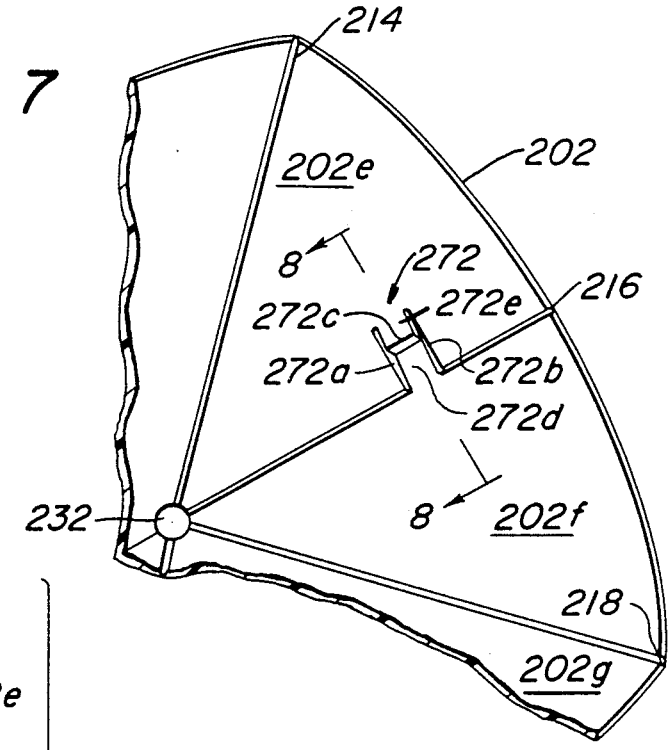
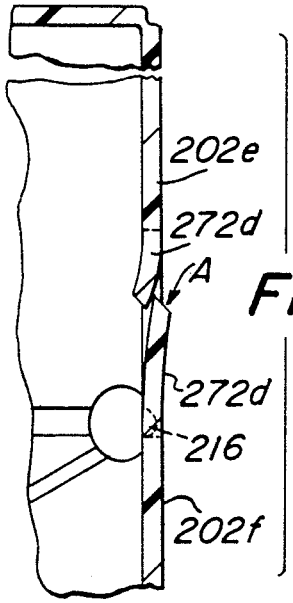
FIG. 8
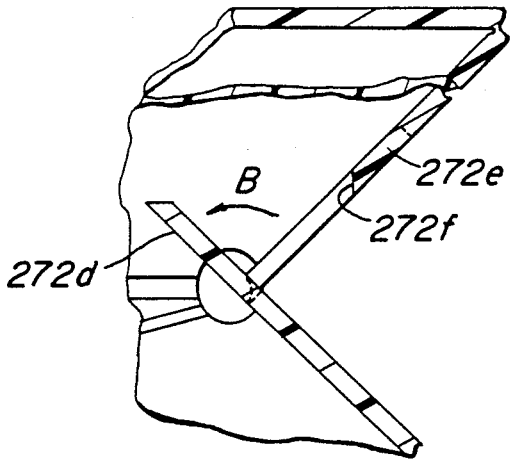
FIG. 9

FIG. 10
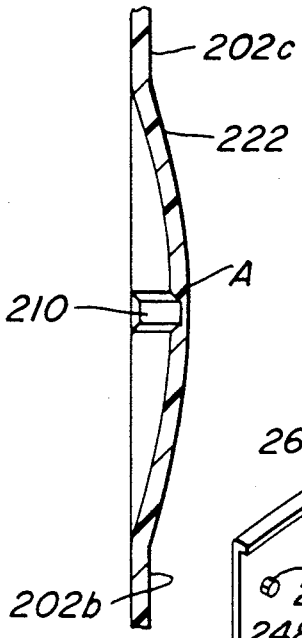
FIG. 11
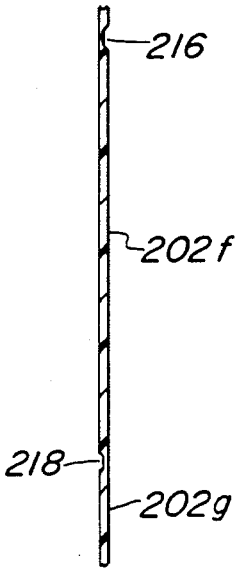
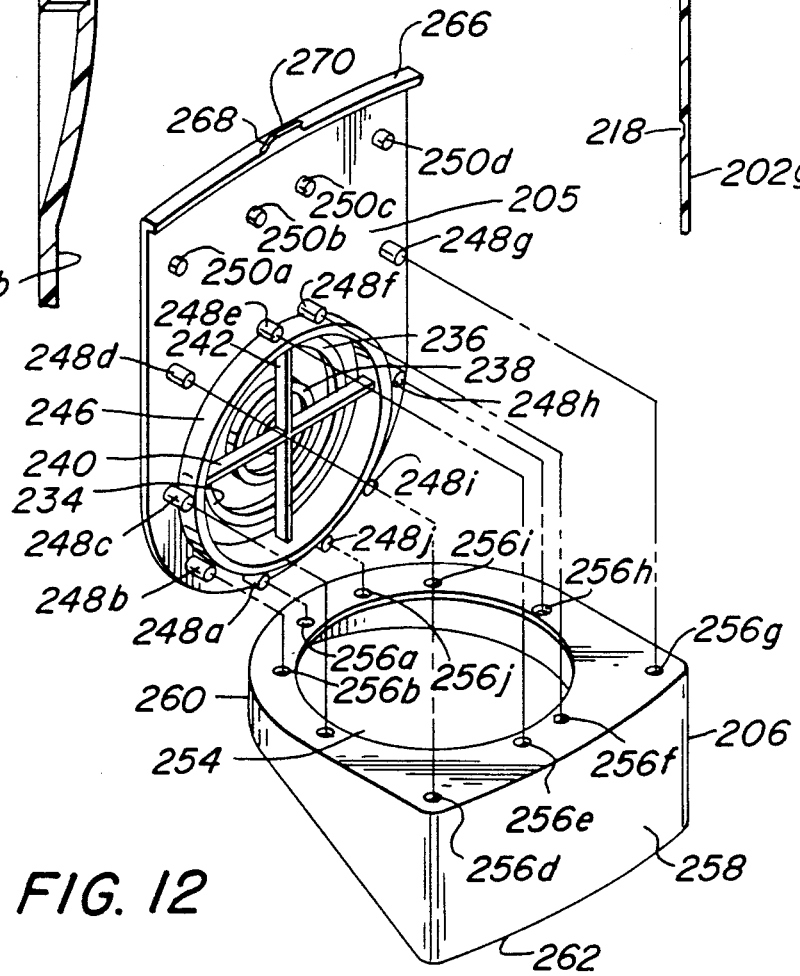
FIG. 12

VAPORIZER AND/OR FACIAL TREATMENT DEVICE

FIELD OF THE INVENTION

This invention relates generally to a vaporizer and/or a facial treatment device, and more particularly the invention relates to a type of collapsible hood for use in channeling vapors flowing from the treatment device.

BACKGROUND ART

Vaporizer devices or facial treatment devices are known for complexion care, such as to provide steam facials. Examples of previous types of these devices include U.S. Pat. Nos. 3,152,240 (Scott) and 3,351,737 (Katzerman et al.) These units employ rigid hood members which are open at one end so that the person receiving the facial treatment can place his or her face thereover during the treatment process. These devices are generally bulky and difficult to transport due to the size and rigidity of the hoods employed therein.

In order to overcome the drawback of the relatively large and bulky hood, U.S. Pat. No. 4,621,641 (Frank et al.) discloses a vaporizer and/or facial treatment device which utilizes a collapsible hood for controlling the flow of steam so that a more compact and easily transportable arrangement is provided than prior art types of facial treatment devices.

It is also known to design light weight, portable hair dryers with collapsible hoods which are adapted to be opened up and placed over the user's head for the purpose of drying the user's hair. The collapsible hood can thereafter be folded into a compact arrangement for storage when the dryer is not in use. A dryer of this type is disclosed in U.S. Pat. No. 4,361,966 (Downey.)

A facial sauna device employing a plastic substrate which can be positioned into a facial shield for channeling steam to a user's face is disclosed in U.S. Pat. No. 3,493,722 (FIGS. 22–26), issued to Popeil. When not in use as a shield the substrate can be wrapped about the steam chest of the facial sauna to function as a protective carrying case (FIGS. 30 and 31).

OBJECTS OF THE INVENTION

It is an object of this invention to provide a vaporizer and/or facial treatment device employing a collapsible hood, and which hood can be easily formed and used.

It is a further object of the invention to provide a vaporizer and/or facial treatment device employing a collapsible hood, which hood is simply and easily maintained in its open position, but which can be easily collapsed and secured in a folded or closed position for easy storage or transportation of the device.

Another object of this invention is to provide a vaporizer and/or facial treatment device having a hood, wherein the orientation of the hood on the device is adjustable.

Another object of this invention is to provide a collapsible hood of a unique and easy-to-use construction.

Yet another object of the invention is to provide a convenient locking system for maintaining the collapsible hood in its folded, collapsed position for storage and transportation.

SUMMARY OF THE INVENTION

In furtherance of these objectives a vaporizer and/or facial sauna is provided which includes a base unit for heating a liquid such as water which provides the facial treatment vapors and a collapsible hood unit for channeling the vapors rising from the base unit. The hood unit includes a shield member of molded plastic having a plurality of panels separated by hinge lines about which the panels may be folded to collapse the shield. Between at least two adjacent panels, the hinge line is disrupted in its planar direction by a stiffening formation which inhibits the adjacent panels from folding about the hinge line. In one embodiment the stiffening formation is a depression positioned along the hinge line; in a second embodiment the stiffening formation is formed of interlocking members cut from one of the adjacent panels along the hinge line separating the panels.

Because the hood unit is larger when the shield member is in its open position, it is more convenient to collapse the shield to store or transport the device. In order to retain the shield in the collapsed state, two different forms of locking arrangements are provided which prevent the collapsed shield from opening. One locking arrangement includes a loop extending from one panel which can be positioned around a protrusion extending from the hood unit. A second locking arrangement includes a hole through one of the panels which is adapted to fit around and be held beneath a protrusion extending from the hood unit.

In the most preferred embodiment of this invention a hood unit is removably mounted on a base unit, and can be positioned in different orientations on the back unit to channel vapors rising from the base unit in different directions.

BRIEF DESCRIPTION OF THE DRAWINGS

Additional objectives and a core complete understanding of the invention will become apparent from the following detailed description taken in conjunction with the formal drawings, wherein:

FIG. 2 is a sectional view taken along the line 2—2 in FIG. 1.

FIG. 5 is a cross-sectional view showing the collapsible hood in the collapsed position.

FIG. 7 is an alternate embodiment of the locking mechanism for the collapsible hood.

FIG. 8 is a sectional view taken along the line 8—8 in FIG. 7.

FIG. 9 is a cross-sectional view similar to FIG. 8 showing the alternate locking system for the collapsible hood with the hood in a partially collapsed position.

FIG. 10 is an enlarged sectional view taken along the line 10—10 in FIG. 6.

FIG. 11 is an enlarged sectional view taken along the line 11—11 in FIG. 6.

FIG. 12 is an isometric view showing the underside of the baffle member and the top surface of the base member.

DESCRIPTION OF THE PREFERRED EMBODIMENTS OF THE INVENTION

Figure 1:
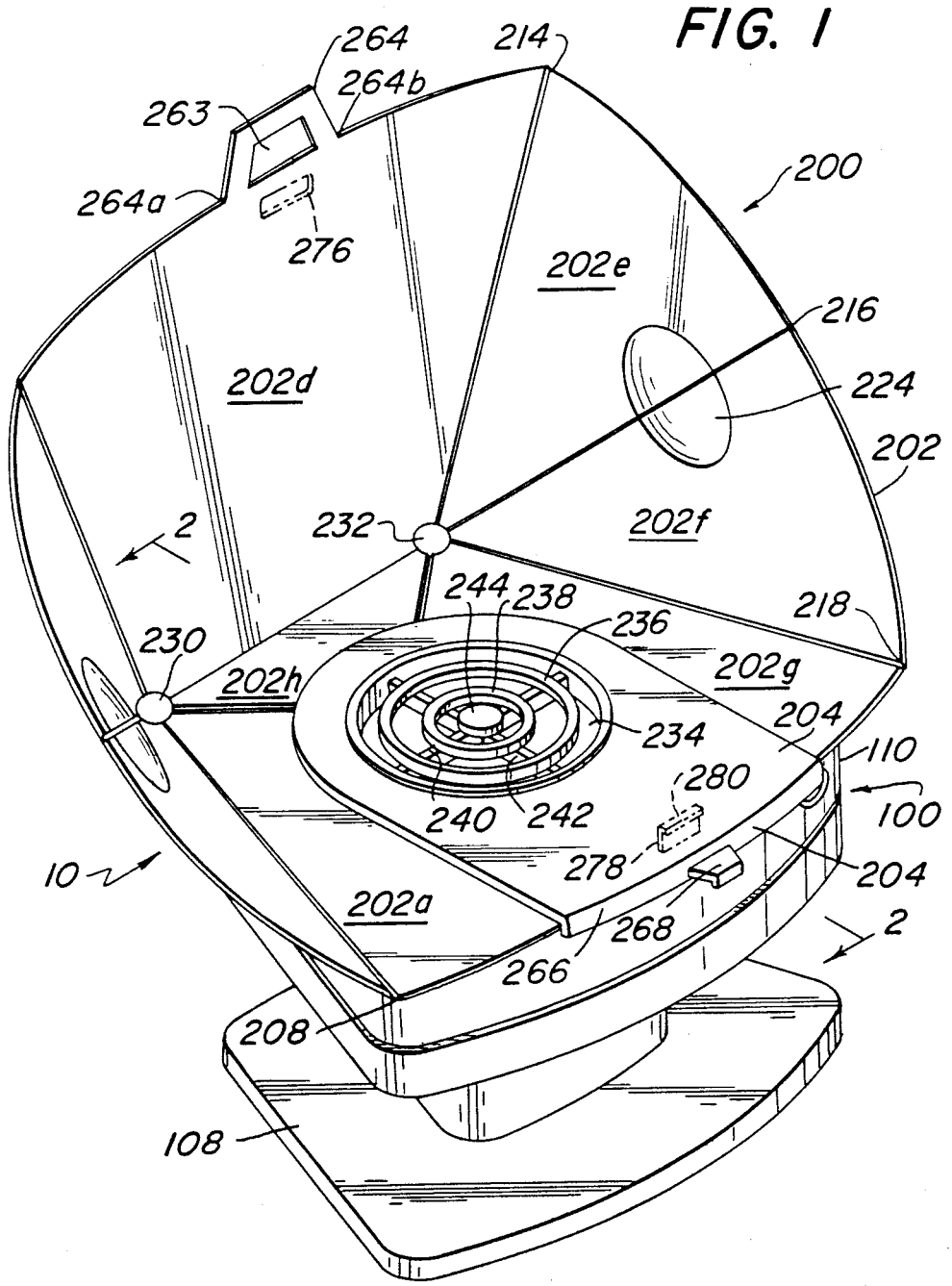
FIG. 1 is an isometric view showing the vaporizer and/or facial treatment device in accordance with this invention with the collapsible hood in the open position.

Referring now in greater detail to the various figures of the drawings, wherein like reference characters refer to like parts, a vaporizer and/or facial treatment device embodying the present invention is generally shown at 10 in FIG. 1. The device comprises generally a molded plastic base 100 wherein liquid to be vaporized for facial treatment is contained and heated. Removably fitted onto the base 100 is a collapsible hood 200 which controls the flow of vapors from the base unit and collects the vapors for facial treatment.

As shown in FIG. 2, the base unit 100, includes a hollow molded plastic housing member 110 with an opening 112 thereinto. A preferred plastic usable for the housing member is a polycarbonate, such as Merlon, Type M-40 manufactured by Mobay Chemical Corporation. A metal container 114 fits into the opening 112 above a conventional heating element 116. A flexible seal 117 surrounds the rim 115 of the container 114 where the container fits into the opening 112. The metal container 114 contains a liquid (e.g., water) to be vaporized by heat supplied by the metal heating element 116. (It should be noted that other mechanisms can be used to heat the liquid, and the specific type of heating mechanism does not constitute a part of the present invention.) The vaporized liquid from the container rises upward and is channeled in the hood unit 200 above the base unit 100. The face of the user of the invention can then be positioned close to the hood unit 200 so that the vaporized liquid rising from the metal container 114 can be used for facial treatment.

As shown in FIGS. 1 and 2, the base unit 100 also includes a molded plastic pedestal 108 onto which is mounted the molded plastic housing 110.

The hood unit 200, as shown in FIGS. 1–3 and 5, includes a collapsible shield member 202, preferably (but not necessarily) made of polypropylene, such as Type 8523 manufactured by Himont Inc., a baffle member 204 and a base member 206. Both the baffle member and base member preferably are made from the same polycarbonate employed to form the housing member 110. The shield member 202 is shown in its unfolded, unassembled, flat condition in FIG. 6. The relationship of the baffle member 204 to the base member 206 is also shown in FIG. 12, with the collapsible shield member 202 omitted for clarity.

Figure 6:
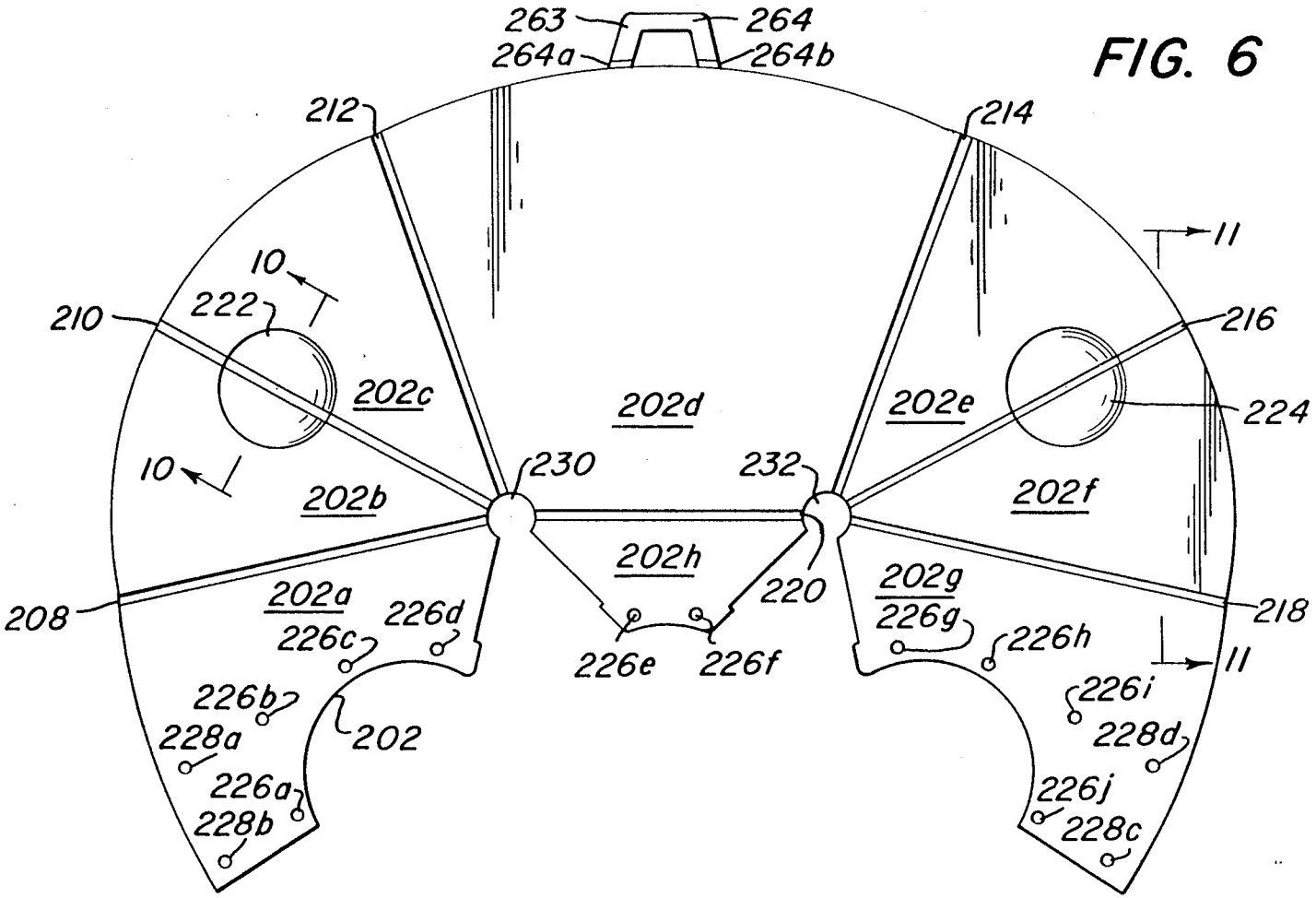
FIG. 6 is a plan view of one embodiment of the collapsible hood prior to being folded.

In the preferred embodiment as shown in FIG. 6, the shield member 202 is a unitary piece of molded plastic comprising eight panels **202*a*–202*h*. The various panels, though contiguous with at least one adjacent panel, are delineated from the adjacent panel(s) by a hinge or cutline 208–220 which has a reduced thickness in comparison to the adjacent panels. (See FIG. 11.) The cutlines 208–220 serve as flexible areas along which the shield member 202 can be folded to form the hood shape as seen in FIG. 1. In order to further faciliate folding of the shield member 202, the hinge lines 208, 212, 214, 218, and 220 are grooved along the rear surface thereof as shown in FIG. 11. In contrast, the hinge lines 210, 216 between adjacent panels 202*b*, 202*c* and 202*e*, 202*f*, respectively, are grooved in the opposite direction, as also shown in FIG. 11. By forming the hinge lines 208–220 in this grooved manner, it is easier to fold the shield member into the collapsed form shown in FIG. 5**.

As further shown in the various figures and particularly in FIGS. 1, 6 and 10, adjacent panels **202*b*, 202*c* and 202*e*, 202*f* have formed therein circular depressions 222, 224 respectively. As shown in FIG. 10, the underside A of the depression 222 extends below the plane created by the adjacent panels 202*b*, 202*c*. Likewise, depression 224 extends beneath the plane created by adjacent panels 202*e*, 202*f*. As can be further seen from the figures, hinge lines 210, 216 intersect the depressions. Because the depressions and the portions of the hinge lines 210, 216 passing therethrough are not in the same plane as, i.e., extend below, the plane of the adjacent panels, the hinge lines 210, 216 are disrupted along the length thereof. It has been found that by disrupting the hinge line and forming the two depressions in the adjacent panels that the shield member 202 when folded into the operative position as shown in FIG. 1 is much more rigid than a similar structure which does not have the circular depressions 222, 224 which disrupt the orientation of the hinge lines 210, 216. Although the depressions 222, 224 can be positioned anywhere along the hinge lines 210, 216, a maximum locking strength is achieved by positioning the depressions toward the outer edge of the shield member 202. In the embodiment shown in FIG. 1, the depressions 222, 224 are positioned along the hinge lines 210, 216, respectively, less than half the distance of the hinge line from the outer edge of the shield member 202**.

To facilitate assembling the shield member 202 into the opened form shown in FIG. 1, a plurality of holes **226*a*–226*j* (FIG. 6) are provided through panels 202*a*, 202*h*, and 202*g*. As will be discussed later in conjunction with FIG. 12, these holes cooperate with the baffle member 204 and base member 206 so that a construction for the hood unit 202 can be completed. Additional holes 228*a*–228*d* are also provided in panels 202*a* and 202*g* and cooperate with the baffle member 204 to secure the-shield member 202** thereto.

To faciliate folding the shield member 202 into the collapsed form shown in FIG. 5, a first cutout 230 (FIG. 1), is provided at the base of the hinge lines 208, 210, 212 and 220 and a second cutout 232 is provided at the base of the hinge lines 214, 216, 218 and 220. By providing the cutouts 230, 232, when the panels **202*a*–202*h* are folded along the hinge lines, the material forming the shield member 202** is not bunched together at the intersection of all the hinge lines, and a sharp point is avoided at the intersection. This is important, since the natural resiliency of the shield material tends to urge the panels away from their collapsed position.

The baffle member 204 as shown in FIGS. 1, 2 and 12 has an opening 234 therethrough with concentric baffle rings 236, 238 positioned within the opening 234 on perpendicular support bars 240, 242. At the concentric center of the baffle rings 236, 238 is a baffle disk 244. Extending downward from the underside 205 of the baffle member 204 is a rim 246 extending downward from the edge of the opening 234. Also projecting from the underside 205 of the baffle member 204 are a plurality of rod-like members **248*a*–248*j* which are adapted to fit through the holes 226*a*–226*j* in the panels 202*a*–202*h* of the shield member 202. Additional rod like members 250*a*–250*d* project downward from the underside 205 of the baffle member 204 near the forward edge thereof. These rod-like members 250*a*–250*d* are designed to pass through the holes 228*a*–228*d* when the panels 202*a*, 202*g* are brought together along the hinge lines. When all of the rod-like members 248*a*–248*j* and 250*a*–250*d* are inserted through the holes 226*a*–226*j* and 228*a*–228*d*, respectively, in the shield member 202, the shield member 202 takes on the configuration as shown in FIG. 1**.

Further provided in conjunction with the hood unit 200 is the base member 206 which has a circular opening 254 therethrough. (See FIGS. 2–4 and 12) This opening 254, which can be other than circular if desired, is slightly larger in diameter than the opening 234 through the baffle member 204 and is adapted to receive snuggly therein the circular rim 246 extending downward from the underside 205 of the baffle member 204. Surrounding the circular opening 254 are a plurality of smaller openings 256*a*–256*j* positioned to correspond to the locations of the rod-like-members 248*a*–248*j* on the underneath side of the baffle member 204 (FIG. 12).

Figure 4:
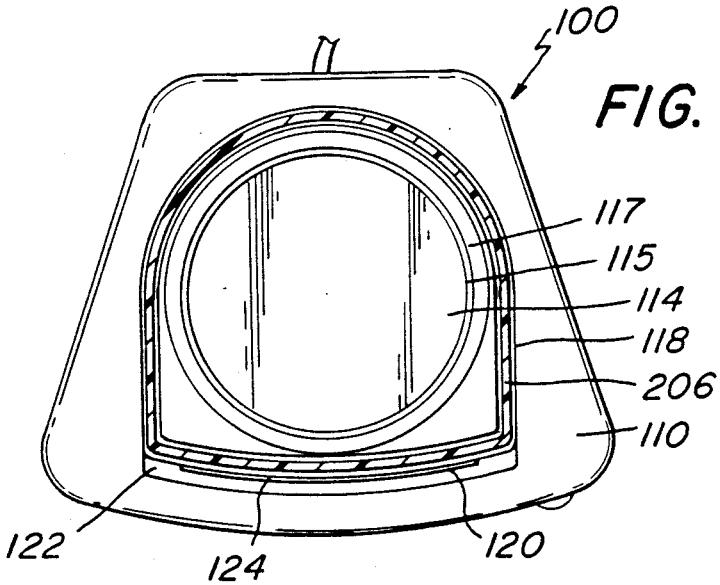
FIG. 4 is a sectional view taken along the line 4—4 in FIG. 2.

As further shown in FIGS. 2, 4 and 12, the base member 206 is designed to fit within the housing 110. The base member 206 is significantly deeper at the front portion 258 thereof than at the rearward portion 260 thereof.

The housing 110 of the base unit 100 has a first groove 118 around the inside thereof surrounding the opening 112 which holds the metal container 114. The groove 118 receives the bottom edge 262 of the base member 206. FIG. 2 shows the base member 206 fitted within the groove 118 with the bottom edge 262 resting on the bottom 126 of the groove, so that the surface of the baffle member 204 rests parallel with the top of the housing 110.

Figure 3:
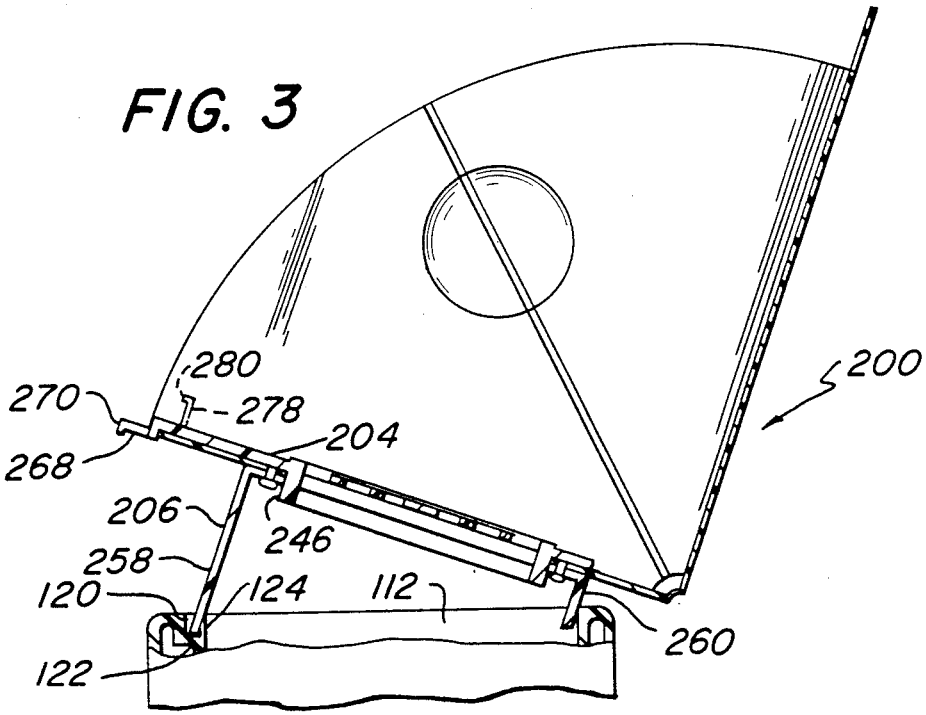
FIG. 3 is a sectional view similar to FIG. 2 showing the open hood in an angled position.

As shown in FIGS. 2–4, the housing 110 further contains a second groove 120 therein positioned toward the front of the housing, above and in front of the deeper first groove 118. This second groove 120 comprises a ledge 122 having a lip 124 extending partially thereacross. The deeper front portion 258 of the base member 206 can be positioned within this second groove 120 so that the base member 206 and the entire hood unit 200 can be positioned at an angle (FIG. 3) -above the opening 112 in the base unit 100.

To assemble the hood unit 200, the shield member 202 is folded along hinge lines 208, 212, 214, 218 and 220 as shown FIG. 1. The hinge lines 210 and 216 are not folded. The baffle member 204 is then positioned over the folded shield member 202 and the rod-like members 248*a*–248*j* are inserted through the holes 226*a*–226*j* in the shield member 202. Additi of rod-like members 250*a*–250*d* are pressed through corresponding holes 228*a*–228*d* in the shield member 202. The rod-like members 248*a*–248*j* passing through the holes 226*a*–226*j* in the shield member are further pressed through the openings 256*a*–256*j*, respectively, in the base member 206. Thereafter, the rod-like members 248*a*–248*j* are heat sealed to the base member and rod-like members 250*a*–250*d* are heat sealed to the underside of the shield member 202.

From the open position as shown in FIG. 1, the shield member 202 can be folded into a more compact position for transportation and storage as shown in cross-section in FIG. 5. To collapse the shield member 202, the hinge lines 210, 216 disrupted at the depressions 222, 224, respectively, are pressed inward and panels 202*b*, 202*f* are collapsed inward against panels 202*a* and 202*g*, respectively. Panel 202*d* is pressed downward toward the baffle member 204 and the side panels 202*c*, 202*e*.

Because the material forming the shield member 202 has a natural tendency to return to its flattened position, if some means is not provided, the shield will attempt to open again, from its collapsed position. To this end, panel 202*d* has at the edge thereof a loop member 264 (FIGS. 1 and 6). The loop member 264 is preferably molded with the shield member 202, and has hinge lines 264*a*, 264*b* at the junction of the loop member 264 and the panel 202*d* of the shield member 202. The baffle member 204 has extending-from the forward edge 266 a protrusion 268 which is of a size to fit into the opening 263 in the loop 264. At the end of the protrusion 268 is a downwardly extending lip 270. When the shield member 202 is collapsed as shown in FIG. 5, the loop member 264 is pressed downward at the hinge lines 264*a*, 264*b*, thereby forcing the loop member over the protrusion 268 to cause the protrusion to extend through the opening 263 in the loop 264, and thereby secure the the shield member 202 in the collapsed position. Because the natural resiliency of the material urges the shield member to return to its flattened state, the loop 264 is held tightly against the protrusion 268 and lip 270.

To open the shield member 202 from the collapsed state, the loop member 264 is simply pulled from the protrusion 268, and the hinge lines 210, 216 are pushed outward at the depressions 222, 224 until the hinge lines 210, 216 each their locked position.

The vaporizer or facial sauna is operated by removing the entire hood unit 200 from the base unit 100 and thereafter filling the metal container 114 with the fluid (e.g., water) to be vaporized. The hood unit 200 is replaced and the heating element 116 actuated to begin the heating of the fluid and the vaporizing action.

The hood unit 200 can be adjustably positioned so that the baffle member 204 is horizontal, as shown in FIG. 2, by placing the bottom 262 of the baffle member 204 in the first groove 118, or the front edge 258 of the baffle member 204 can be positioned on the ledge 122 of the second groove 120, thereby angling the hood as shown in FIG. 3.

An alternate embodiment of the shield member 202 is shown in FIGS. 7–9. Rather than provide the depressions 222, 224 along the hinge lines 210, 216 which disrupt the planar orientation of the hinge lines 210, 216, in this alternate embodiment, the hinge lines are disrupted by a lock member cut into one of the adjacent panels of the shield member 202, again, at a distance less than half the length of the hinge line from the outer edge of the shield member. The representation of this alternate embodiment shown in FIGS. 7–9, shows only the lock member 272 located alonge hinge line 216. A similar lock member is envisioned for hinge line 210, though not shown. The lock member 272 has two cutlines 272*a*, 272*b*, respectively, transverse to and intersecting (and thereby disrupting) the hinge line 216. In the illustrated embodiment these cutlines 272*a* and 272*b* are parallel to each other. A third cutline 272*c* angled between the top and a bottom surfaces of the panel (as shown in FIGS. 8 and 9 at A) is provided to separate the lock member 272, into two pieces 272*d*, 272*e*.

With respect to lock member 272, for example, when the shield member 202 is in the open position as shown in FIGS. 7 and 8, the lower piece 272*d* is urged underneath or behind the upper piece 272*e*, thereby preventing the adjacent panels 202*e*, 202*f* from folding inward along hinge line 216. (In a similar locking manner, panels 202*b* and 202*c* are prevented from folding along hinge line 210, thus maintaining the shield member 202 in the open position.)

Because the shield member 202 is formed from rigid, yet pliable material, in order to collapse the shield member 202 of the second embodiment as shown in FIG. 9, the lower lock piece 272*d* is simply pushed inward (arrow B in FIG. 9) past the lower edge 272*f* of the upper piece, thereby releasing it from its locked position behind the upper piece 272e.

A second embodiment of the locking mechanism for holding the shield member 202 in the collapsed position is shown in phantom in FIG. 1. Rather than use the loop 264 and horizontal protrusion 268 at the forward edge of the baffle member 204, an opening 276 is provided in the center panel 202d and a vertical protrusion 278 is provided which extends upward from the baffle member 204. The protrusion 278 has extending from the forward edge thereof a lip 280. The opening 276 is so positioned that when the shield member 202 is collapsed, the vertical protrusion 278 passes through the opening 276 and the panel 202d is held under the lip 280. To release the locking engagement the flexible panel 202d is manually forced upward until the edge of the opening 276 clears the lip 280.

Without further elaboration the foregoing will so fully illustrate my invention that others may, by applying current or future knowledge, adopt the same for use under various conditions of service.

What I claim is:

1. An apparatus for vaporizing a liquid said apparatus comprising:

base unit means for containing and vaporizing said liquid, said base unit means having an opening therein to allow said liquid when vaporized to exit therethrough;

hood means overlying said opening in said base unit means for channeling said vaporized liquid exiting from said base unit means through said opening, said hood means being comprised of: shield means collapsible between open and closed positions for channeling said vaporized liquid exiting through said opening when said shield means is in the open position, said shield means including a plurality of adjacent panels and first locking means for preventing said shield means from collapsing to the closed position when it is desired that the shield means remain in the open position; said first locking means being positioned between at least two of said adjacent panels; said adjacent panels being connected by a hinge line about which said panels are movable; and said first locking means comprising a disruption along the length of said hinge line intermediate the ends thereof and located between said two adjacent panels.

2. The apparatus as claimed in claim 1 wherein at least two of said adjacent panels are formed from a single sheet of material, said two panels being separated by a hinge line of said material, and said sheet of material being flexible about said hinge line.

3. The apparatus as claimed in claim 1 wherein said disruption comprises a single depression in said two adjacent panels and along said hinge line therebetween.

4. The apparatus as claimed in claim 1 wherein said disruption comprises a bridge of said material across said hinge line, said bridge being formed by two cuts through one of said two adjacent panels transverse to and intersecting said hinge line and a third cut through said material between said two lines.

5. The apparatus as claimed in claim 1 wherein said disruption is located at a position spaced less than half the distance of said hinge line from the outer edge of said panels.

6. The apparatus as claimed in claim 1 wherein said hood means is separate from said base unit means and is removably fitted onto said base unit means overlying the opening in said base unit means.

7. The apparatus as claimed in claim 1 wherein said hood means further comprises:

base member means connected to said shield means and adapted to be received in said base unit means around said opening for positioning said shield means in a location overlying said opening; and baffle member means connected to said base member means for channeling the flow of vaporized liquid out of said opening.

8. The apparatus as claimed in claim 7 wherein said base unit means has a substantially horizontal top surface and has a first groove therein adapted to receive said base member means therein and said base member means is removeably fitted in said first groove.

9. The apparatus as claimed in claim 8 wherein said base unit means includes a second groove therein above said first groove adapted to receive said base member means therein, so that the top of said base member means is angled with respect to the top surface of said base unit means.

10. The apparatus as claimed in claim 1 including second locking means for maintaining the shield means in the closed position.

11. The apparatus as claimed in claim 7 wherein said shield member means is further engageable with said baffle member when said shield member means is in the closed position for retaining shield member means in the closed position.

12. The apparatus as claimed in claim 8 wherein said baffle member means has a projection extending therefrom; and said shield member means has an opening therethrough positioned to pass around and engage said projection on said baffle member means when said shield member means is collapsed into the closed position.

13. The apparatus as claimed in claim 12 wherein:

said opening in said shield member means is through one of said panels; and said projection projects upward from said baffle member means, whereby when said shield member means is collapsed, said opening in said panel passes over and engages said project projecting upward from said baffle member means.

14. The apparatus as claimed in claim 12 wherein:

said shield member means further comprises a loop member extending from one of said panels, said loop member having said opening therethrough; and said projection extends outwardly away from said baffle member means in the same plane as said baffle member means, whereby when said shield member means is collapsed said loop member with said opening therethrough can be forced around and engage said projection extending from said baffle member means.

15. An apparatus for vaporizing a liquid, said apparatus comprising:

base unit means for containing and vaporizing said liquid, said base unit means having an opening therein to allow said liquid when vaporized to exit therethrough;

hood means removably mountable on the base unit means for overlying said opening in said base unit means to channel the vaporized liquid exiting from said base unit means through said opening, said hood means being comprised of a shield means for channeling the vaporized liquid exiting through the opening of the base unit means and base member means connected to the shield means and adapted to be received in said base unit means around said opening for positioning said shield means in a location overlying said open said base unit means having first and second grooves therein, said second groove being in a different plane from said first groove, and each of said first and second grooves being adapted to receive the base member means therein for orienting the shield means in different angular orientations relative to the base unit means.

16. The apparatus as claimed in claim 15 wherein the shield means is collapsible between open and closed positions for channeling said vaporized liquid exiting through said opening when said shield means is in the open position, said shield means including a plurality of adjacent pannels and first locking means for preventing said shield means from collapsing to the closed position when it is desired that the shield means remain in the open position.

17. The apparatus as claimed in claim 16, wherein said first locking means is between at least two of said adjacent panels, said adjacent panels being connected by a hinge line about which said two adjacent panels are movable, and said first locking means comprises a disruption positioned on said hinge line intermediate the ends thereof.

* * * * *